United States Patent [19]

Hoffman

[11] 4,082,234

[45] Apr. 4, 1978

[54] MILLING WHEELS FOR SMALL FLOUR MILLS

[76] Inventor: Douglas Hoffman, W. 3507 LaCrosse, Spokane, Wash. 99205

[21] Appl. No.: 779,253

[22] Filed: Mar. 18, 1977

[51] Int. Cl.[2] ..... B02C 7/13

[52] U.S. Cl. ..... 241/248; 241/261.3; 241/296

[58] Field of Search ..... 241/248, 260, 261.2, 241/261.3, 296

[56] References Cited

U.S. PATENT DOCUMENTS

| | | | |
|---|---|---|---|
| 170,120 | 11/1875 | Smith | 241/296 |
| 891,050 | 6/1908 | Durham | 241/261.3 |
| 1,098,324 | 5/1914 | Kihlgren | 241/261.3 |
| 1,705,996 | 3/1929 | Pope | 241/296 |
| 3,638,871 | 2/1972 | Barger | 241/296 X |
| 3,688,996 | 9/1975 | Kuest | 241/248 UX |

FOREIGN PATENT DOCUMENTS

| | | | |
|---|---|---|---|
| 2,202,798 | 8/1973 | Germany | 241/296 |

*Primary Examiner*—Roy Lake
*Assistant Examiner*—Howard N. Goldberg
*Attorney, Agent, or Firm*—Wells, St. John & Roberts

[57] ABSTRACT

A matched pair of coaxial milling wheels for small flour mills such as those used in homes. A stationary milling wheel and an adjacent rotatable milling wheel each have a common central axis. Each includes first and second radial surfaces spaced along the axis. The adjacent faces of the wheels have a center cavity extending axially inward and defining the inner periphery of an annular milling face extending to the wheel periphery. Complementary grooves are formed in the milling face of both wheels to feed grain radially outward from the central cavities and to assist in cracking and grinding the particles to a fine state. The wheels are formed integrally from fired stoneware and have machined flat annular rims about the milling faces to assure accurate final grinding of the particles before they exit from the space between the two wheels.

9 Claims, 9 Drawing Figures

MILLING WHEELS FOR SMALL FLOUR MILLS

BACKGROUND OF THE INVENTION

This disclosure relates to milling wheels of the type used in home grain mills having a stationary milling wheel and an adjacent powered or rotatable milling wheel. Examples of these types of mills are shown in the Kuest U.S. Pat. No. 3,688,996 and the Grover U.S. Pat. No. 3,880,367. Another description of grain milling wheels is contained in U. S. Pat. No. 3,942,730 to Coucher. A further disclosure and discussion of this type of mill is set out in my co-pending application Ser No. 680,490 filed Apr. 26, 1976, now U.S. Pat. No. 4,039,153, issued Aug. 2, 1977, which is hereby incorporated by reference.

Experience in milling grains by use of home mills has been erratic. Most such mills utilize very hard abrasive grinding or milling wheels which are relatively expensive and are easily clogged by the material being ground. Furthermore, the use of very hard abrasive surfaces in close proximity to one another while rotating at a high speed pose serious problems of surface damage if the surfaces are brought into contact accidently. It has also been difficult to attain the degree of fine milling needed to produce cake flours from wheat, and virtually impossible to mill oily materials, such as corn or soft oily materials such as soybeans.

SUMMARY OF THE INVENTION

The matched pair of coaxial milling wheels for small flour mills include a stationary milling wheel fixed relative to a central axis and a coaxial rotating milling wheel powered about the central axis. The milling wheels each have first and second axially spaced radial surfaces. A center cavity extends axially inward from the first radial surface of each wheel. An annular milling face is located about the first radial surface between the center cavity and the periphery of the wheel. The milling face has a plurality of grooves angularly spaced about the central axis of the wheel. Each groove extends from the center cavity to a location spaced inwardly from the milling wheel periphery, thereby defining an outer annular rim about the edges of the milling face. The grooves on the respective milling wheels are designed to facilitate cracking and feeding of granular material as it moves from the center cavities of the wheels to the annular rims. The surface configurations on the two complementary rims are such as to make maximum use of the rotational movement between the two wheels to facilitate cracking and grinding of the grain particles.

It is a first object of this invention to provide a pair of practical milling wheels which can be fabricated from relatively inexpensive materials, such as fired stoneware. The resulting milling wheels are durable and can be replaced, when eventually worn, at a relatively modest cost in comparison to wheels constructed of hard abrasive materials.

Another object of the invention is to provide milling wheels which have relatively smooth surface configurations in comparison to the surfaces of harder abrasive materials, and which therefore are not subject to being clogged by the material being milled. The present wheels are essentially self-cleaning in use, and can be readily brushed clean or washed when necessary.

Another object of this invention is to provide a set of milling wheels which can be fabricated to precision tolerances to permit exceptionally fine milling of flour in a home grain mill.

These and further objects will be evident from the following disclosure and the accompanying drawings which illustrate a preferred embodiment of the milling wheels.

DESCRIPTION OF THE PREFERRED EMBODIMENT

Figure 1:
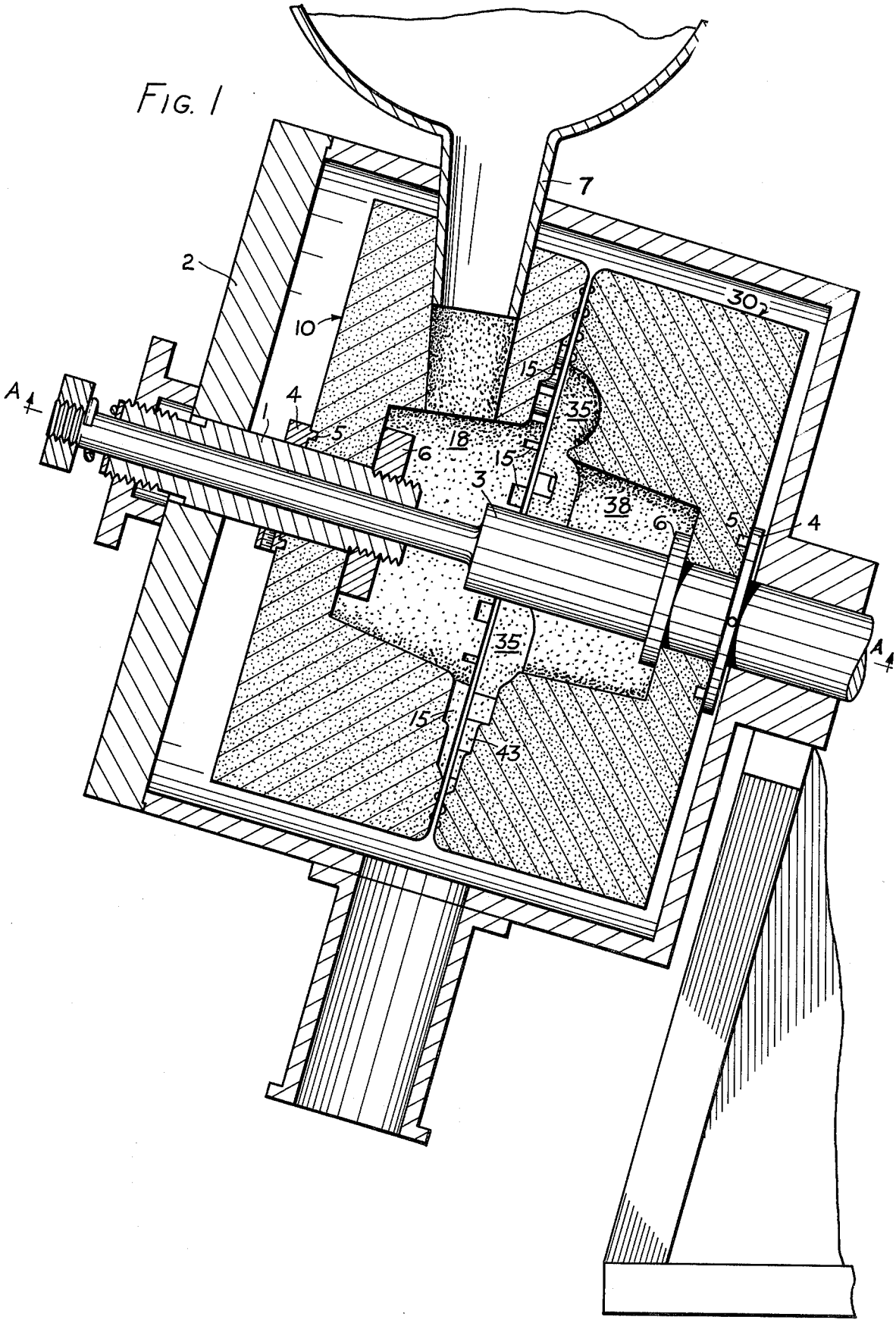
FIG. 1 is a simplified fragmentary sectional view through a vertical plane within a grain mill, illustrating use of the milling wheels.

This disclosure relates to a matched set of milling wheels for home use. The milling wheels are capable of being used in various powered arrangements, FIG. 1 merely illustrating a basic mounting arrangement found to be most useful with respect to the development of these particular wheels.

The stationary milling wheel is generally illustrated at 10. The adjacent rotatable milling wheel is indicated at 30. The two wheels 10, 30 are mounted along a common central axis shown at A-A. The stationary milling wheel is fixed to a stationary shaft 1 supported on a frame 2. A coaxial rotatable shaft 3 mounts the rotatable milling wheel 30. Each wheel is mounted to its respective shaft by an outer collar 4 having interfitting projections 5 received within apertures in the wheels. The milling wheels are secured to the respective shafts by removable threaded nuts shown at 6. Material to be milled is fed through the stationary milling wheel from a hopper generally shown at 7 and exits from frame 2 downwardly beneath the two wheels after being milled.

In this type of mill, the shaft 3 is powered by an electric motor (not shown). Provision is made for axial adjustment of shaft 1 relative to shaft 3 to provide adjustment of the clearance between the adjacent surfaces on the milling wheels 10, 30. This permits the user to select the degree of fineness in the resulting flour.

This disclosure is concerned with the fabrication and details of the milling wheels, and not with the details of the mill itself. Other alternative mechanical arrangements can be utilized for mounting the wheels for rotational movement of wheel 30 with respect to the stationary milling wheel 10.

As can be seen in the drawings, the two milling wheels have substantial areas of similarity, although they complement one another in actual use. They are preferably of the same diameter and thickness, although this is not a necessary design factor. They are similarly mounted to the shafts 1, 3, which simplifies the mountalong with a tapped winding generally disclosed at 63. If it is assumed that the transformer 62 is a step-down type the tapped winding 63 has two separate winding portions 64 and 65 of a relatively low voltage. The upper end of the tapped winding 64 is connected by a conductor 66 to a relay coil 67 that is magnetically coupled as shown at 68 to two normally open contacts 70 and 71, along with a normally closed contact 72. It will be noted that the normally open contact 70 is connected to the terminal 55 to receive the line voltage L1 and in turn is connected to a further terminal 73 so that the line L1 can be supplied on conductor 74 to a burner programmer generally disclosed at 75 of any convenient type. The line voltage L2 is again disclosed and would be part of conductor 54 to supply the balance of the electrical energy to the burner programmer 75. The burner programmer 75 is disclosed schematically as having a pair of conductors 76 and 77 that control the burner 23. This portion of the circuitry can be varied extensively depending on the type of burner programmer 75 used and the type of burner 23 that is operated.

The limit and control device is again considered and it is noted that the conductor 47 connects to the relay coil 67. The conductor 46 is connected to a tap on the transformer at 80 and the conductor 45 is connected to a junction 81 between the safety switch heater 82 and the normally opened relay contact 71. The electric circuitry is completed by a conductor 83 that connects one end of the tapped winding 63 to the normally closed contact 72 that in thurn is connected to the safety switch heater 82. It will be noted, by the dash linee 84, that the safety switch heater 82 is coupled to the safety switch 60. This is a conventional type of safety switch wherein the switch contacts 60 are of the trip-free type and are mechanically latched closed until the safety switch heater 82 has been heated by current passing through it for a sufficiently long period of time at which time the switch 60 opens. Once the switch 60 opens, it requires manual reset in order to close the contact 60 to the condition shown.

OPERATION OF FIG. 1

The operation of FIG. 1 is described with the system considered to be at a proper operating temperature with the limits 51 and burner control 52 closed along with the snap switch 33 being closed to supply energy to the heater 20 under the influence of the bulb and capillary 25 and 26. The thermoferrite switch or means 40 is in the position shown with the contact 43 open and the contact 42 closed as long as the temperature of the oil in tank 14 is at or above a temperature to maintain a sufficiently low viscosity of the oil to be supplied to the burner 23. Under these conditions, the primary winding 61 is supplied with electrical energy so that the secondary winding 63 is also energized. An initial energizing circuit is then completed through the relay coil 67, conductor 47, the closed switch 42, the common conductor 45 and the safety switch heater 82 along with the normally closed relay contact 72. This complete circuit provides the necessary energizing current for the relay coil 67 and the relay immediately pulls in. This closes the contact 70 to supply the burner programmer 75 and the burner 23 with electrical energy for proper operation.

At the time that relay coil 67 is energized and contact 70 closes, contact 71 also closes thereby providing a hold-in path for relay coil 67 through closed switch 42 and opening the normally closed contact 72 to remove voltage from safety switch heater 82. Contact 71 closes before contact 72 opens. This arrangement provides for a check of the continuity of the safety switch heater 82 as a pull in portion of the circuit for the relay 67. To this point, the normal operation of the device has been disclosed.

In the event that the oil heater 20 fails to keep the temperature of the oil at a sufficiently high temperature for proper operation of the burner 23, the thermoferrite switch means 40 is caused to operate with the switch 42 opening and the contact 43 closing. The opening of the contact 42 causes an open circuit to the relay coil 67 and the relay drops out immediately and the contacts 70, 71 and 72 move to the position shown in FIG. 1. At this same time the contact 43 is closed and provides a circuit between the tap 80, through the closed contact 43 to the junction 81, through the safety switch heater 82, and through contact 72, so that the safety switch heater is then continuously heated by the voltage appearing across the portion 65 of the secondary winding 63. The continuous flow of current heats the heating element 82 and eventually opens the safety switch 60. This removes power from the unit so that the burner programmer 75 and burner 23 can no longer receive power, and requires manual reset of the safety switch 60 prior to reestablishement of operation of the device. This, therefore, calls the attention to service personnel that the oil preheater in tank 14 is not functioning properly and this type of malfunction can be corrected.

Figure 2:
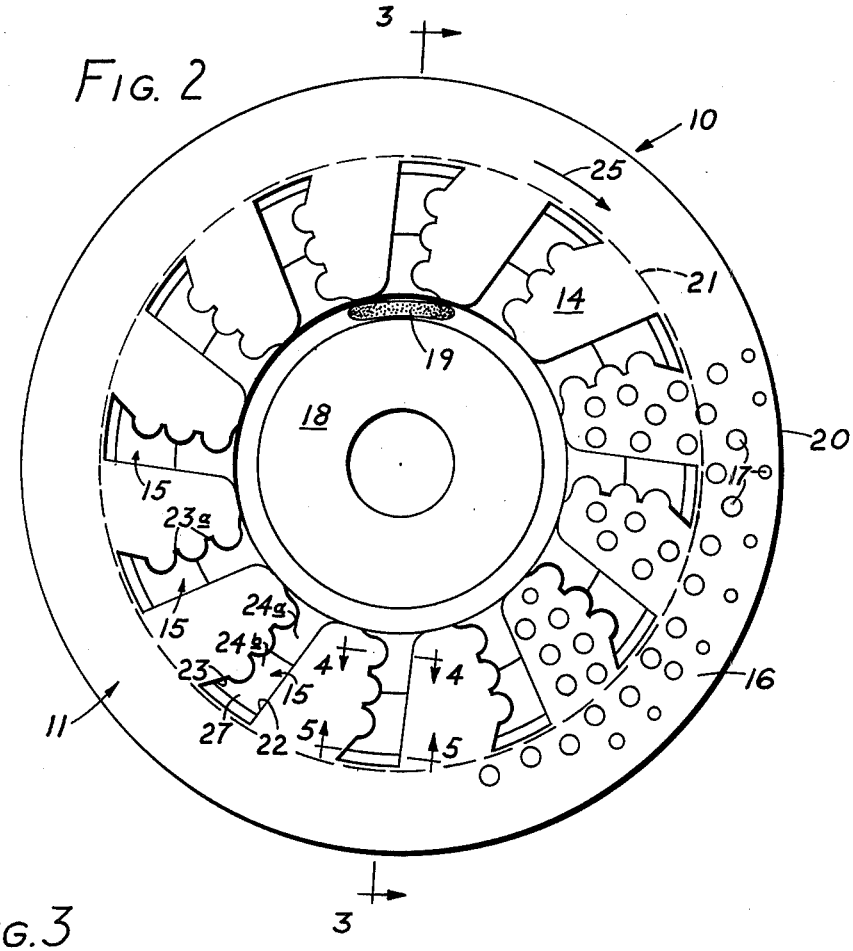
FIG. 2 is a plan view of the operative face of the stationary milling wheel.
Figure 3:
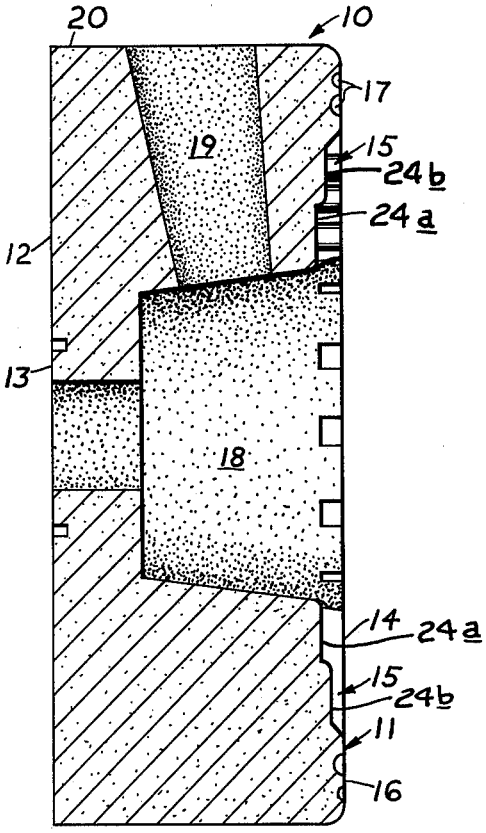
FIG. 3 is a sectional view taken along line 3—3 in FIG. 2.
Figure 4:
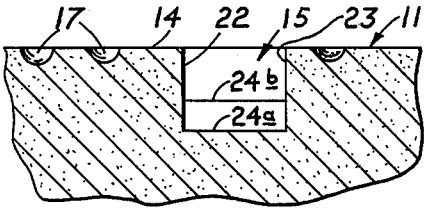
FIG. 4 is an enlarged fragmentary sectional view taken along line 4—4 in FIG. 2.
Figure 5:
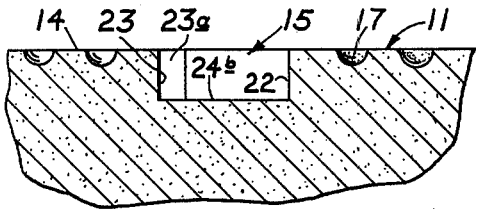
FIG. 5 is an enlarged fragmentary sectional view taken along line 5—5 in FIG. 2.

The circuit disclosed is a safe start check arrangement and allows for the monitoring the oil temperature to provide for safe operation of a burner 23. In FIG. 2 there is disclosed an arrangement wherein the limit and control device 10 of FIG. 1 has been broken into the housing or enclosure 11' and the well 12 as mounted in the tank 14. In this case the conductors 45, 46 and 47 are sufficiently long to reach between the well 12 and the enclosure 11'. In this case the capillary 26' has been provided that is of sufficient length to provide the separation between the well 12 and the enclosure 11'. This arrangement allows for the remote mounting of the housing 11' which encloses the limit and control device. This adds great flexibility in the adaptation and mounting of the entire device in a burner control system.

The present invention provides for a very simple system to install and one which is very competitive from a cost standpoint. The exact types of switches utilized in the well 12 can vary and a preferred type of switch has been described. The variance from one type of temperature responsive switch to another can be made by those skilled in the art. The scope of the present invention is therefore, limited solely by the scope of the appending claims.

The embodiments of the invention in which an exclusive property or right is claimed are defined as follows.

1. A limit and control for heavy oil preheating adapted for use with an oil burner system, including: oil temperature sensing means including first temperature responsive switch means adapted to operate an oil heater used to preheat heavy fuel oil to maintain a sufficiently low viscosity to properly utilize the fuel oil; said oil temperature sensing means further having second temperature responsive switch means including a single-pole, double-throw switch; transformer means including a primary winding adapted to be connected to a source of power, and a tapped, secondary winding; said tapped secondary winding connected to a first circuit including a relay, a portion of said second switch the center of wheel 10. The walls 22, 23 of grooves 15 diverge outwardly from the center of wheel 10, the angle of divergence being approximately five degrees. This divergency or flaring of grooves 15 resists the tendency of material within the grooves to dam or pack within them, assuring room for continuous material migration in a radial direction.

The individual grooves 15 terminate in enlarged cavities 27 open to the surface 11. The inner surfaces of cavity 27 are tapered toward the plane of the surface 11 in both the radial direction and in the direction of arrow 25. Therefore, grain particles within grooves 15 are forced toward the adjacent rotating surfaces on wheel 30 by both centrifugal force and by the dragging frictional forces which lead them in the direction of arrow 25.

While grooves 15 are designed to facilitate outward migration of granular particles, it has been found desirable to also provide means to impede such motion temporarily in order that hard particles are not simply wedged between the shearing walls of the wheels and moved outward with no resistance. This is accomplished by the ledge formed at the base of each groove 15 between lands **24*a* and 24*b*, and by tangential teeth 23*a* formed along each groove wall 23**. The teeth act as serrations to hold grain while it is being sheared or cracked.

Figure 6:
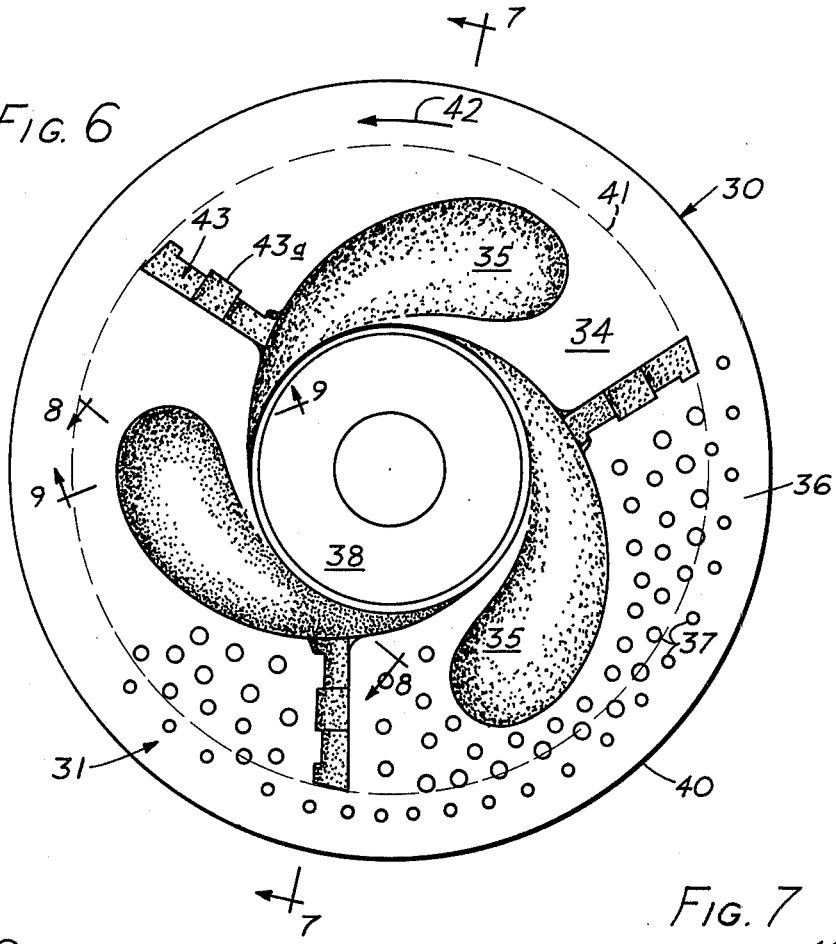
FIG. 6 is a plan view showing the operative face of the rotatable milling wheels.
Figure 8:
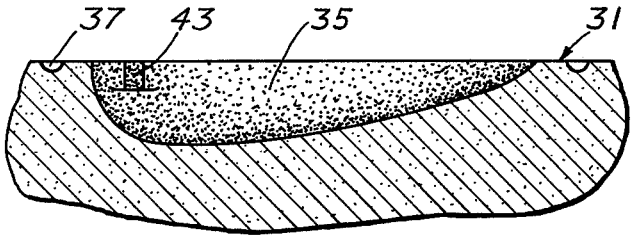
FIG. 8 is an enlarged sectional view taken along line 8—8 in FIG. 6.
Figure 9:
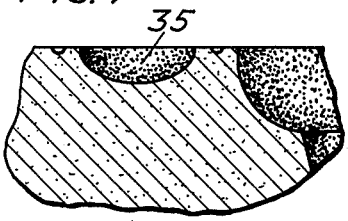
FIG. 9 is an enlarged fragmentary view taken along line 9—9 in FIG. 6.
Figure 7:
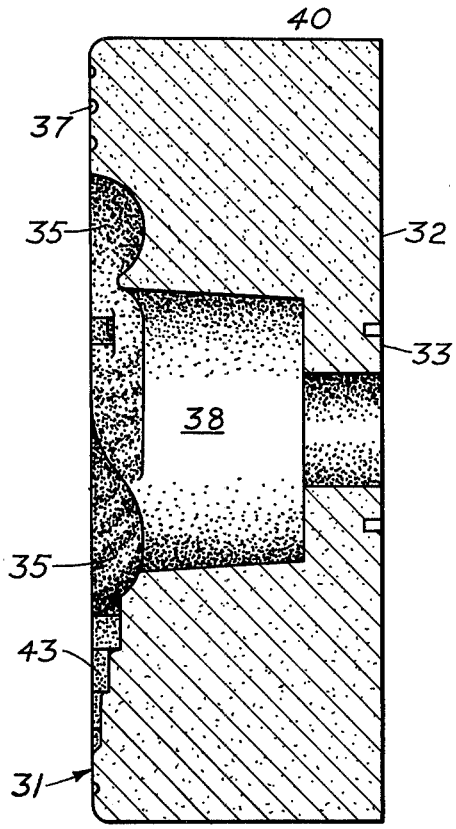
FIG. 7 is a sectional view taken along line 7—7 in FIG. 6.

The details of grooves 35 on the rotatable milling wheel 30 are illustrated in FIGS. 7 and 8. Grooves 35 are formed in a teardrop shape, having curved walls progressively enlarged in width in a direction leading outward from the center cavity 38. They are curved tangentially in a direction opposite to the rotational direction of wheel 30, the intended direction of rotation being shown in FIG. 6 by the arrow 42. The walls of grooves 35 curve inwardly to corner edges formed at their intersection with the first radial surface 31.

The rotatable milling wheel 30 is also illustrated as having radially inclined slots 43 which are stepped along their length and interrupt the surface 11 and which terminate at the rim 36. The slots 43 are inclined oppositely to the grooves 15, so that the respective indentations and relatively straight side walls thereof tend to crack kernels of grain with a "scissors" effect for more efficient shearing. They also have teeth **43*a* along their cutting sides, to complement teeth 23*a*** described above.

The teardrop-shaped grooves 35 serve a primary purpose of feeding substantial quantities of grain in a tangential direction outward from the center cavities 18, 38. The pressure of the incoming grain forces the material into the stationary grooves 15 of wheel 10 where the kernels are sheared by subsequent impact and grinding due to the indentations on the rotatable wheel surface 31. It is to be noted that both the grooves 15 and the grooves 35 expand in width in a direction radially outward from the axis at the center of the wheels 10, 30. This assures that there will be sufficient room to permit incoming material to continuously be moved outwardly under the pressure of the feeding granular material, eliminating the possibility of the partially cracked or milled material being jammed between constricting surfaces on the wheels.

The illustrated wheels accomplish milling by a combination of various effects. Primary reduction of the particles is accomplished by shearing or cracking the original kernels between the walls of the grooves 15, 35 and the overlapping slots 43, which are formed in the rotatable wheel 30. The hemispherical dimples or recesses 17 provide a multiple number of small indentations which again overlap one another on the two wheels and break the particles down into smaller sizes. Because of their hemispherical shape, the recesses or dimples 17 produce a reduction in every direction of movement of the particles between the two wheels 10, 30. In contrast, the grooves 15, 35 and slots 43 cooperate to move and reduce the granular materials in a directional process which is both radial and tangential. The grooves 15, 35 and slots 43 crack the kernels, while the dimples or recesses 17 reduce the particles to a smaller powder. Finally, the particles are ground between the abrasive surfaces of the adjacent rims 16, 36, resulting in production of very fine flours in a single pass of material through the area between the two wheels 10, 30. Because of the accurately machined rims 16, 36, and the ability of stoneware to withstand rubbing movement, rims 16, 36 can actually be powered while lightly rubbing one another, thereby assuring that the flour particles leaving from between them are in an extremely fine ground state. It has been found practical to actually produce "cake flour" from wheat by use of a home mill using these wheels. Similar fine flours can also be produced from other granular materials, including both soybeans and corn.

The described wheels have been designed and used on home mills powered by three-quarter horsepower electric motors and driven at 1800 RPM. The wheels tested in this manner had an outside diameter of five inches. They were capable of milling wheat at a rate of one pound per minute at a very fine setting with the rims 16, 36 lightly rubbing one another. The same milling capacity was found with respect to corn. They worked equally well in milling soybeans, a product which is impractical to mill by use of abrasive milling wheels found commonly in home grain mills. The same wheels were found to be equally effective when powered at lower speeds, including half speed at 900 RPM.

Variations are possible with respect to the details discussed above, and for these reasons only the following claims are intended as definitions of my invention.

Having described my invention, I claim:

1. In a matched pair of coaxial milling wheels for small flour mills having a stationary milling wheel adapted to be fixed relative to a transverse axis and a coaxial rotatable milling wheel adapted to be powered about the transverse axis:

said milling wheels each having:

(a) a circular disk having a central axis;

(b) first and second axially spaced radial surfaces formed on the disk and being joined by a peripheral surface;

(c) a center cavity open to the first radial surface on the disk and extending axially inward therefrom a portion of the axial distance between the first and second radial surfaces;

(d) a planar annular milling face formed on said first radial surface between the center cavity and the milling wheel periphery;

said stationary milling wheel further comprising:

(a) a feed aperture formed within the milling wheel and leading from its peripheral surface to said cavity for directing grain inward to the cavity for milling purposes;

(b) said annular milling face having a plurality of grooves having side walls slightly offset from a radian through central axis and substantially perpendicular to the plane of said milling face, said grooves being angularly spaced about the central axis and extending from the center cavity to locations spaced inwardly from the milling wheel periphery of the stationary milling wheel;

(c) each of said grooves increasing in width and decreasing in depth in a direction outward from the center cavity;

(d) said stationary milling wheel being fabricated as an inegral unit from fired stoneware, the exterior surfaces of the stationary milling wheel being glazed and fired during fabrication, and the outermost rim of the annular milling face between its grooves and wheel periphery having fired stoneware material exposed across a plane perpendicular to the central axis;

said rotatable milling wheel further comprising:

(a) said annular milling face having a plurality of tangentially curved grooves each formed in a teardrop shape, having curved walls progressively enlarged in width in a direction leading outward from the center cavity, each groove being in open communication with the center cavity of the rotatable milling wheel, said grooves being angularly spaced about the center axis and extending tangentially outward in a direction opposite to the intended direction of rotation of the rotatable milling wheel about the center axis, each groove extending from the center cavity to a location spaced inwardly from the periphery thereof;

(b) each of said grooves increasing in width and decreasing in depth in a direction outward from the center cavity;

(c) said rotatable milling wheel being fabricated as an integral unit from fired stoneware, the exterior surfaces of the rotatable milling wheel being glazed and fired during fabrication and the outermost rim of the annular milling face between the grooves and wheel periphery having fired stoneware material exposed across a plane perpendicular to the central axis.

2. An apparatus as set out in claim 1 wherein the annular grinding faces of both milling wheels have a plurality of hemispherical recesses formed therein.

3. An apparatus as set out in claim 1 wherein the annular grinding faces of both milling wheels have a plurality of hemispherical recesses formed therein and wherein the depth of the recesses progressively diminished toward the wheel periphery.

4. A stationary milling wheel comprising:

(a) a circular disk having a central axis;

(b) first and second axially spaced radial surfaces formed on the disk and being joined by a peripheral surface;

(c) a center cavity open to the first radial surface on the disk and extending axially inward therefrom a portion of the axial distance between the first and second radial surfaces;

(d) a feed aperture formed within the milling wheel and leading from its peripheral surface to said cavity for directing grain inward to the cavity for milling purposes;

(e) a planar annular milling face formed on said first radial surface between the center cavity and the milling wheel periphery;

(f) said annular milling face having a plurality of grooves having side walls slightly offset from the radian through said central axis and substantially perpendicular to the plane of said milling face, said grooves being angularly spaced about the central axis and extending from the center cavity to locations spaced inwardly from the milling wheel periphery;

(g) each of said grooves increasing in width and decreasing in depth in a direction outward from the center cavity;

(h) said milling wheel being fabricated as an integral unit from fired stoneware, the exterior surfaces of the milling wheel being glazed and fired during fabrication, and the outermost rim of the annular milling face between the grooves and wheel periphery having fired stoneware material exposed across a plane perpendicular to the central axis.

5. An apparatus as set out in claim 4 wherein the annular grinding face has a plurality of hemispherical recesses formed therein.

6. An apparatus as set out in claim 4 wherein the annular grinding face has a plurality of hemispherical recesses formed therein and wherein the depth of the recesses progressively diminishes toward the wheel periphery.

7. A rotatable milling wheel comprising:

(a) a circular disk having a central axis;

(b) first and second axially spaced radial surfaces formed on the disk and being joined by a peripheral surface;

(c) a center cavity open to the first radial surface on the disk and extending axially inward therefrom a portion of the axial distance between the first and second radial surfaces;

(d) an annular milling face formed on said first radial surface between the center cavity and the milling wheel periphery;

(e) said milling face having a plurality of tangentially curved grooves formed in a teardrop shape, each groove having curved walls progressively enlarged in width in a direction leading outward from the center cavity, said grooves being angularly spaced about the center axis and extending tangentially outward in a direction opposite to the intended direction of rotation of the milling wheel about the center axis, each groove extending from the center cavity to a location spaced inwardly from the milling wheel periphery;

(f) each of said grooves increasing in width and decreasing in depth in a direction outward from the center cavity;

(g) said milling wheel being fabricated as an integral unit from fired stoneware, the exterior surfaces of the milling wheel being glazed and fired during fabrication, and the outermost rim of the annular milling face between the grooves and wheel periphery having fired stoneware material exposed across a plane perpendicular to the central axis.

8. An apparatus as set out in claim 7 wherein the annular grinding face has a plurality of hemispherical recesses formed therein.

9. An apparatus as set out in claim 7 wherein the annular grinding face has a plurality of hemispherical recesses formed therein and wherein the depth of the recesses progressively diminishes toward the wheel periphery.

* * * * *